US010304393B2

(12) United States Patent
Lin et al.

(10) Patent No.: US 10,304,393 B2
(45) Date of Patent: May 28, 2019

(54) BRIGHTNESS COMPENSATION METHOD AND CIRCUIT

(71) Applicant: NOVATEK MICROELECTRONICS CORP., HsinChu (TW)

(72) Inventors: Cheng-Wen Lin, Toufen (TW); Chin-Yuan Tu, Taoyuan (TW); Hui-Hung Chang, Keelung (TW); Chien-Yu Chen, Zhubei (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 107 days.

(21) Appl. No.: 15/681,480

(22) Filed: Aug. 21, 2017

(65) Prior Publication Data

US 2019/0057659 A1 Feb. 21, 2019

(51) Int. Cl.
*G09G 3/34* (2006.01)

(52) U.S. Cl.
CPC ... *G09G 3/3406* (2013.01); *G09G 2310/0237* (2013.01); *G09G 2320/064* (2013.01); *G09G 2320/0646* (2013.01); *G09G 2360/16* (2013.01)

(58) Field of Classification Search
CPC .. G09G 3/3426; G09G 3/3607; G09G 3/3406; G09G 3/3648; G09G 3/3611
See application file for complete search history.

(56) References Cited

U.S. PATENT DOCUMENTS

2005/0134547 A1* 6/2005 Wyatt ..... G09G 3/3406 345/102
2009/0115907 A1* 5/2009 Baba ..... G09G 3/3406 348/672
2010/0066754 A1* 3/2010 Kuroda ..... G09G 3/3406 345/589
2010/0110112 A1* 5/2010 Nakanishi ..... G09G 3/3426 345/690
2014/0267464 A1* 9/2014 Takamaru ..... G09G 3/3406 345/690
2015/0103105 A1* 4/2015 Kim ..... G09G 3/2092 345/690
2015/0123888 A1* 5/2015 Uemura ..... G09G 3/3426 345/102
2015/0279285 A1* 10/2015 Sako ..... G09G 3/3607 345/694
2018/0095575 A1* 4/2018 Ota ..... G06F 3/0412

* cited by examiner

*Primary Examiner* — Sepehr Azari
(74) *Attorney, Agent, or Firm* — McClure, Qualey & Rodack, LLP

(57) ABSTRACT

A brightness compensation method and a brightness compensation circuit for a display device are provided. The brightness compensation method includes the following steps. Receive original image data. Receive backlight timing parameters. Perform brightness compensation according to the image data and the backlight timing parameters. The step of performing brightness compensation includes adjusting at least one of pixel driving data, a driving gamma level, and a driver boost level.

18 Claims, 6 Drawing Sheets

BRIGHTNESS COMPENSATION METHOD AND CIRCUIT

TECHNICAL FIELD

The disclosure relates in general to a display device utilizing a backlight unit, and more particularly to a brightness compensation method and circuit for the display device.

BACKGROUND

As technology advances in the electronics industry, mobile phones and portable devices have become popular in our daily life. Mobile phones are usually equipped with flat panel displays to display information. Among various types of flat panel displays, liquid crystal display (LCD) is the most mature technology and is also most popularized. Because a liquid crystal panel does not emit light by itself, a backlight unit is generally disposed below the liquid crystal display panel to act as a light source.

By applying different voltage levels to a liquid crystal, the liquid crystal can twist at varying degrees to change the amount of light passing through the liquid crystal. It takes certain time for the liquid crystal to change state, often referred as the response time of the liquid crystal. A ghost image may appear on the display panel when the liquid crystal is changing state and the backlight is turned on at the same time. A backlight blinking technique has been proposed to deal with the ghost image problem. The time duration that the backlight unit is turned on (referred as on-time in the following description) is shortened to reduce the overlapping between the backlight on-time and the liquid crystal transition time. However, the reduced backlight on-time decreases the image brightness on the display panel, which may cause visual discomfort to the user. Therefore, it is an important subject in the industry to design a brightness compensation method and circuit for the display device utilizing the backlight unit.

SUMMARY

One of the purposes of the present disclosure is to provide a brightness compensation method and a brightness compensation circuit. Based on the original image data and the backlight timing parameters, the image brightness can be enhanced by the proposed brightness compensation method and circuit.

According to one embodiment of the invention, a brightness compensation method for a display device is provided. The method includes the following steps. Receive original image data. Receive backlight timing parameters. Perform brightness compensation according to the image data and the backlight timing parameters. The step of performing brightness compensation includes adjusting at least one of pixel driving data, a driving gamma level, and a driver boost level.

According to one embodiment of the invention, a brightness compensation circuit for a display device is provided. The brightness compensation circuit includes a content analyzer circuit and a backlight coefficient detection circuit. The content analyzer circuit is configured to receive original image data. The backlight coefficient detection circuit is configured to receive backlight timing parameters. The brightness compensation circuit is configured to adjust at least one of pixel driving data, a driving gamma level, and a driver boost level according to the original image data and the backlight timing parameters.

The invention will become apparent from the following detailed description of the preferred but non-limiting embodiments. The following description is made with reference to the accompanying drawings.

Figure 1:
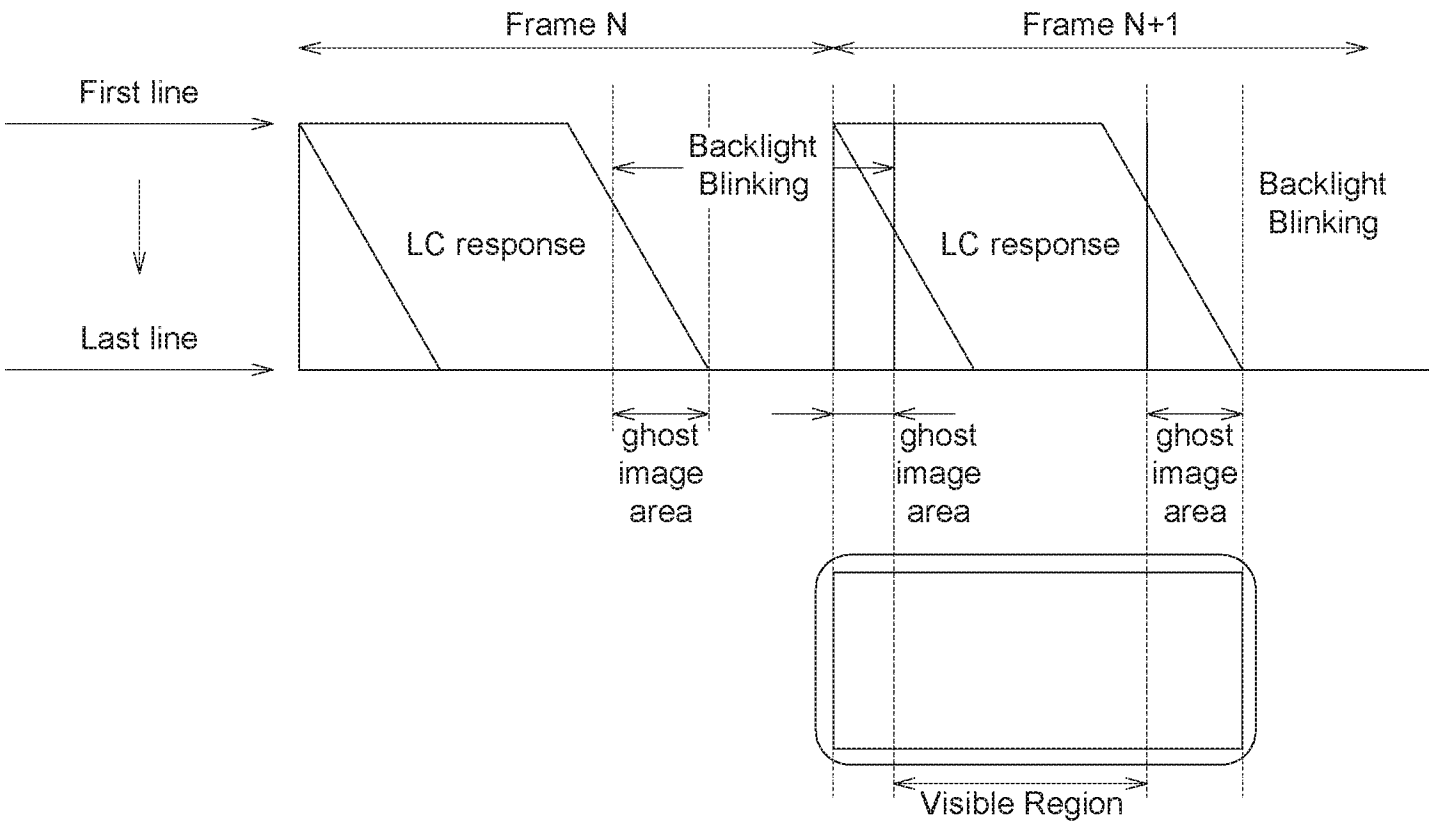
FIG. 1 shows an example of ghost image area caused by backlight blinking applied to a liquid crystal display panel.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

FIG. 1 shows an example of ghost image area caused by backlight blinking applied to a liquid crystal display panel. The parallelogram region represents the liquid crystals changing state from the top row to the bottom row of the display panel. With the backlight blinking technique, the backlight unit is turned on between two display frames (frame N and frame N+1). As can be seen in FIG. 1, due to the response time of the liquid crystal, the bottom part of the screen on the mobile phone may display an image from the previous frame, resulting in a pre-ghost image. The top part of the screen may display another image from the next frame, resulting in a post-ghost image. Shorter backlight on-time reduces the ghost image area, but also reduces the image brightness. A brightness compensation circuit and a brightness compensation method are provided in this disclosure to enhance the image brightness.

Figure 2:
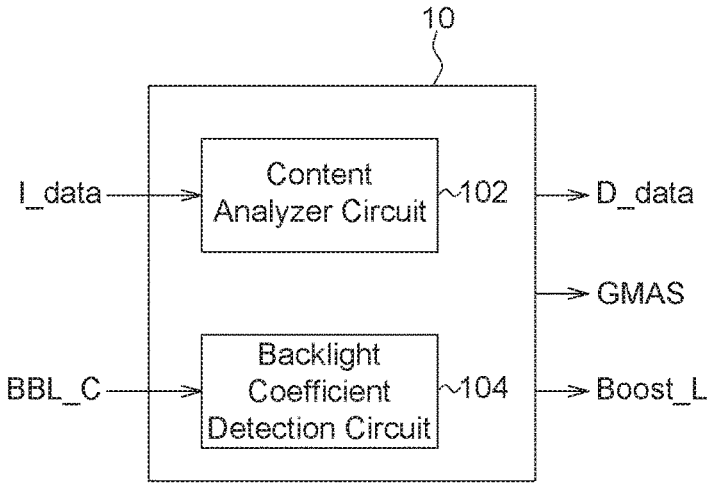
FIG. 2 shows a brightness compensation circuit according to one embodiment of the invention.

FIG. 2 shows a brightness compensation circuit according to one embodiment of the invention. The brightness compensation circuit 10 includes a content analyzer circuit 102 and a backlight coefficient detection circuit 104. The content analyzer circuit 102 is configured to receive original image data I_data. The backlight coefficient detection circuit 104 is configured to receive backlight timing parameters BBL_C. The brightness compensation circuit 10 is configured to adjust at least one of pixel driving data D_data, a driving gamma level GMAS, and a driver boost level Boost_L according to the original image data I_data and the backlight timing parameters BBL_C.

The original image data I_data may include raw pixel data, such as the grayscale value of red, green, blue sub-pixels (ROB values). The backlight timing parameters BBL_C are corresponding to the parameters used in the backlight blinking technique. For example, the backlight timing parameters BBL_C include a backlight start line, a backlight end line, a front porch length, and a back porch length. By receiving the original image data I_data and the backlight timing parameters BBL_C, the brightness compensation circuit 10 can analyze the characteristics of the current image and identify how long the backlight unit is turned on. Based on such information, the brightness compensation circuit 10 may modify at least one of the following parameters to enhance the image brightness: (a) pixel driving data D_data, (b) the driving gamma level GMAS, and (c) the driver boost level Boost_L. The numbers given below are just exemplary rather than limiting the invention.

In the approach (a), the pixel data are modified. For example, the grayscale value in the original image data I_data is 100. The grayscale value in the pixel driving data D_data after brightness compensation becomes 110, and hence increasing the image brightness.

In the approach (b), the gamma voltage is modified. For example, the gamma voltage corresponding to the grayscale value 100 is 1.0V originally. After brightness compensation, the gamma voltage becomes 1.5V to increase the image brightness.

In the approach (c), the driving voltage and/or the driving current for the backlight unit is modified. The backlight unit may have an input parameter (boost level) to control the driving strength. The brightness compensation circuit 10 may provide the driver boost level Boost_L to the backlight unit to increase the driving voltage and/or the driving current to enhance the image brightness.

The number of adjusted parameters (corresponding to the above mentioned approaches (a), (b), (c)) may be one, two, or three. The brightness compensation circuit 10 adjusts at least one of these three parameters according to the original image data I_data and the backlight timing parameters BBL_C to enhance the image brightness.

Figure 5:
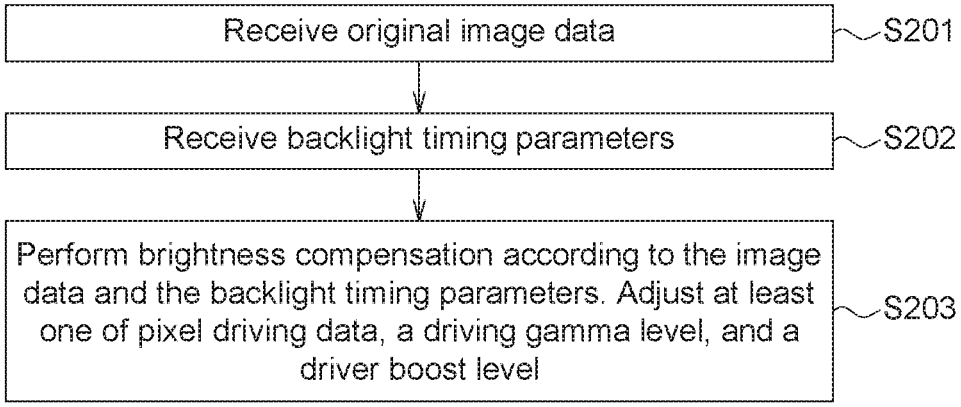
FIG. 5 shows a flowchart illustrating a brightness compensation method according to one embodiment of the invention.

A brightness compensation method is also provided. FIG. 5 shows a flowchart illustrating a brightness compensation method according to one embodiment of the invention. S201: Receive original image data. Step S202: Receive backlight timing parameters. Step S203: Perform brightness compensation according to the image data and the backlight timing parameters. The step S203 may include adjusting at least one of pixel driving data, a driving gamma level, and a driver boost level. The brightness compensation circuit 10 in FIG. 2 is one embodiment for carrying out the method shown in FIG. 5. For example, the step S201 may be performed by the content analyzer circuit 102. The step S202 may be performed by the backlight coefficient detection circuit 104.

In one embodiment, the content analyzer circuit 102 is configured to calculate a luminance value APL according to the original image data I_data. Therefore the brightness compensation circuit 10 knows the brightness property of the current image and also knows how long the backlight on-time is, and hence the brightness compensation circuit 10 may determine how much brightness compensation is required. The brightness compensation circuit 10 is configured to adjust at least one of the pixel driving data D_data, the driving gamma level GMAS, and the driver boost level Boost_L according to the luminance value APL and the backlight timing parameters BBL_C.

Figure 3:
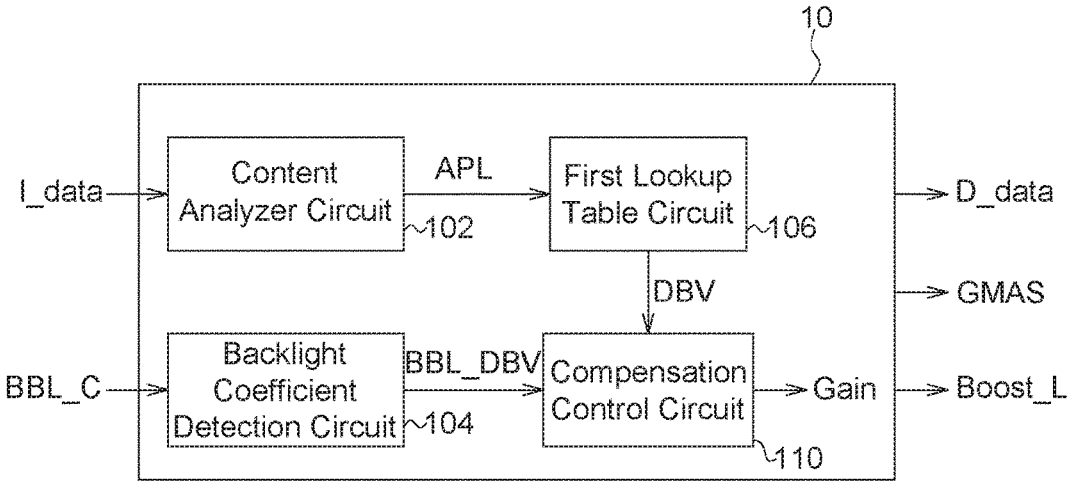
FIG. 3 shows a brightness compensation circuit that calculates a luminance value according to one embodiment of the invention.

FIG. 3 shows a brightness compensation circuit that calculates a luminance value according to one embodiment of the invention. In this embodiment the content analyzer circuit 102 is configured to calculate a luminance value APL according to the original image data I_data. The backlight coefficient detection circuit 104 is configured to calculate a backlight display brightness value BBL_DBV according to the backlight timing parameters BBL_C.

In one embodiment, the luminance value APL is calculated as follows. The content analyzer circuit 102 first converts the pixel in RGB domain to YUV domain. For example, luma $Y=0.299\times R+0.587\times G+0.114\times R$. In an example 8-bit digital circuit implementation, the content analyzer circuit 102 may truncate the original image data I_data to 8 bits, then perform the following calculation: $Y=[2\times R+5\times G+1\times R]>>3$ (">>" means right shift operation.) The content analyzer circuit 102 may calculate the luminance value APL by averaging the Y value of each pixel in the current image.

In one embodiment, the backlight display brightness value BBL_DBV is calculated as follows. The backlight coefficient detection circuit 104 first calculates the number of enabled lines where the backlight is on EN_Line according to the backlight start line, the backlight end line, the front porch length, and the back porch length. The backlight coefficient detection circuit 104 then calculates the backlight display brightness value BBL_DBV by dividing the number of enabled lines EN_Line over the number of total lines, where the number of total lines is equal to the sum of vertical display lines on the screen and the front porch length and the back porch length.

As shown in FIG. 3, the brightness compensation circuit 10 also includes a first lookup table circuit 106 and a compensation control circuit 110. The first lookup table circuit 106 is configured to provide a display brightness value DBV corresponding to the luminance value APL. The compensation control circuit 110 is configured to calculate an equivalent brightness value EBV according to the display brightness value DBV and the backlight display brightness value BBL_DBV, and generate a gain coefficient Gain according to the equivalent brightness value EBV and the backlight display brightness value BBL_DBV.

The first lookup table circuit 106 may be pre-constructed. The first lookup table circuit 106 receives the luminance value APL and outputs the corresponding display brightness value DBV, which represents the display bright value for the current image frame. For example, larger luminance value APL is corresponding to larger display brightness value DBV. The display brightness value DBV is a normalized value to facilitate further combination with the backlight display brightness value BBL_DBV. The display brightness value DBV is a property of the original image, and the backlight display brightness value BBL_DBV is a property of the backlight unit using backlight blinking technique. The compensation control circuit 110 calculates the equivalent brightness value EBV based on these two values.

The equivalent brightness value EBV represents the effective display bright value, which may be a linear combination or a nonlinear combination of the display brightness value DBV and the backlight display brightness value BBL_DBV. The gain coefficient Gain may be related to a ratio between the equivalent brightness value EBV and the backlight display brightness value BBL_DBV. In one embodiment, the gain coefficient $$\text{Gain} = \left(\frac{EBV}{\text{BBL_DBV}}\right)^r,$$

where r is a constant positive real number. For example, r may be smaller than 1. The brightness compensation circuit 10 is configured to adjust at least one of the pixel driving data D_data, the driving gamma level GMAS, and the driver boost level Boost_L according to the gain coefficient Gain.

Figure 6:
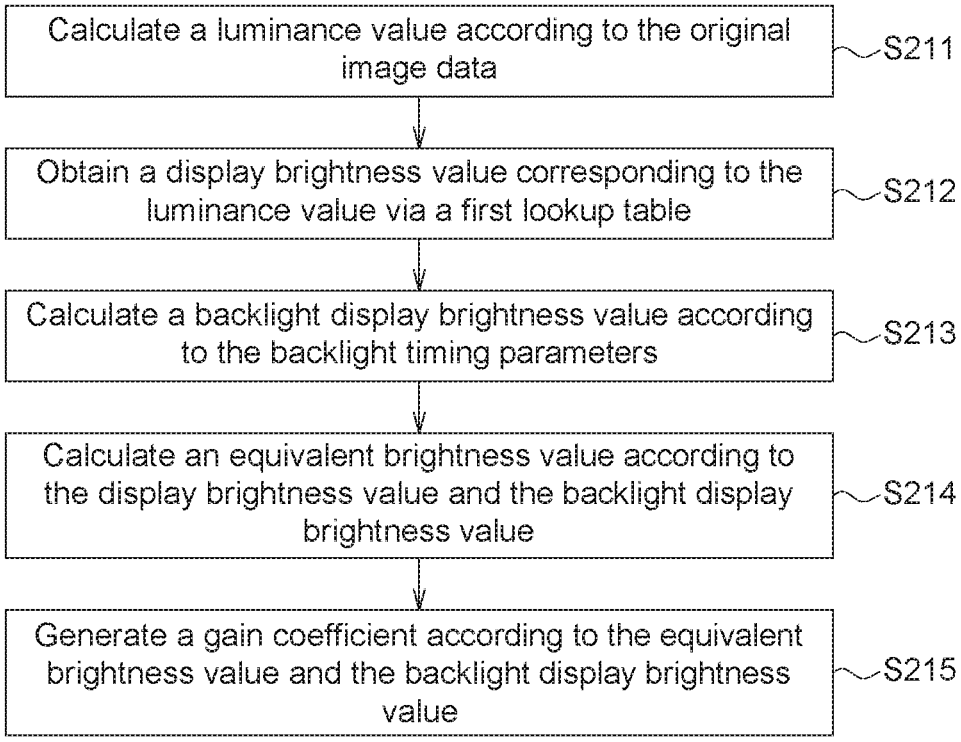
FIG. 6 shows a flowchart illustrating the calculation of the equivalent brightness value and the gain coefficient according to one embodiment of the invention.

FIG. 6 shows a flowchart illustrating the calculation of the equivalent brightness value and the gain coefficient according to one embodiment of the invention. Step S211: Calculate a luminance value according to the original image data. Step S212: Obtain a display brightness value corresponding to the luminance value via a first lookup table. Step S213: Calculate a backlight display brightness value according to the backlight timing parameters. Step S214: Calculate an equivalent brightness value according to the display brightness value and the backlight display brightness value. Step S215: Generate a gain coefficient according to the equivalent brightness value and the backlight display brightness value. Refer to FIG. 5, the step S205 may include adjusting at least one of pixel driving data, a driving gamma level, and a driver boost level according to the gain coefficient.

The brightness compensation circuit 10 in FIG. 3 is one embodiment for carrying out the method shown in FIG. 6. For example, the step S211 may be performed by the content analyzer circuit 102. The step S212 may be performed by the first lookup table circuit 106. The step S213 may be performed by the backlight coefficient detection circuit 104. The step S214 and step S215 may be performed by the compensation control circuit 110.

Figure 4:
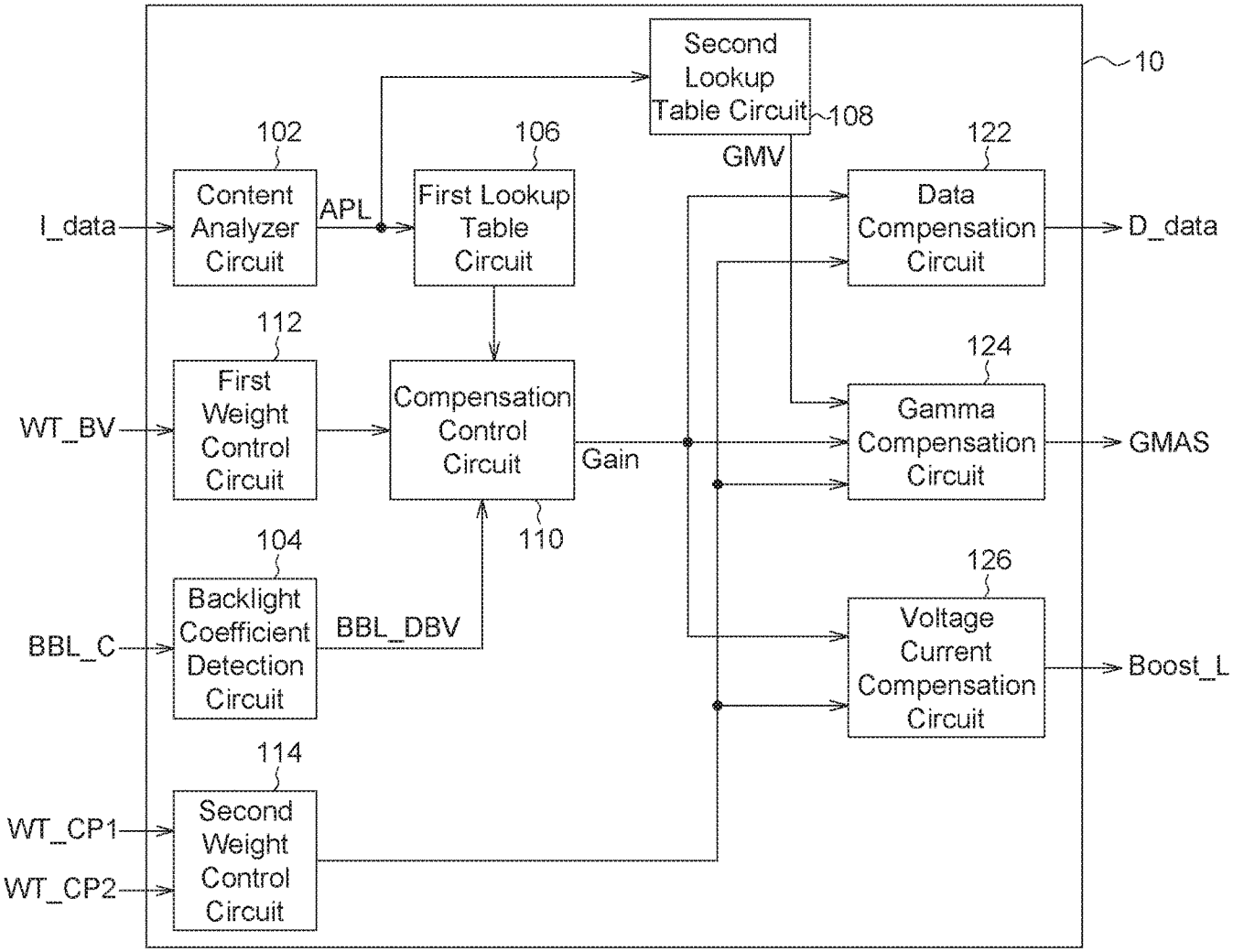
FIG. 4 shows a brightness compensation circuit that includes a weight control circuit according to one embodiment of the invention.

FIG. 4 shows a brightness compensation circuit that includes a weight control circuit according to one embodiment of the invention. In this embodiment the brightness compensation circuit 10 also includes a first weight control circuit 112, a second weight control circuit 114, a second lookup table circuit 108, a data compensation circuit 122, a gamma compensation circuit 124, and a voltage current compensation circuit 126. Each of these circuit modules may be optionally disposed in the brightness compensation circuit 10.

In one embodiment, the equivalent brightness value EBV is a weighted sum of the display brightness value DBV and the backlight display brightness value BBL_DBV. The first weight control circuit 112 receives a brightness weighting coefficient WT_BV. The compensation control circuit 110 is configured to calculate a weighted sum of the display brightness value DBV and the backlight display brightness value BBL_DBV according to the brightness weighting coefficient WT_BV to obtain the equivalent brightness value EBV. For example, EBV=WT_BV×DBV+(1−WT_BV)×BBL_DBV. In a digital circuit representation, the brightness weighting coefficient WT_BV may be an integer ranging from 0 to 100 to represent 0%-100%. The first weight control circuit 112 performs necessary numerical transformation between decimal representation and binary representation to accomplish the weighted sum calculation in the compensation control circuit 110.

The second weight control circuit 114 receives a first compensation weighting coefficient WT_CP1 corresponding to adjustment of the pixel driving data D_data. The second weight control circuit 114 also receives a second compensation weighting coefficient WT_CP2 corresponding to adjustment of the driving gamma level GMAS. The second weight control circuit 114 is configured to calculate a third compensation weighting coefficient WT_CP3 corresponding to adjustment of the driver boost level Boost_L according to the first compensation weighting coefficient WT_CP1 and the second compensation weighting coefficient WT_CP2. For example, WT_CP3=(1−WT_CP1−WT_CP2). These compensation weighting coefficients WT_CP1, WT_CP2, WT_CP3 control how much each of the parameters (pixel driving data D_data, the driving gamma level GMAS, and the driver boost level Boost_L) is adjusted. In a digital circuit representation, these compensation weighting coefficients WT_CP1, WT_CP2, WT_CP3 may be integers ranging from 0 to 100 to represent 0%-100%. The second weight control circuit 114 performs necessary numerical transformation between decimal representation and binary representation.

Figure 7:
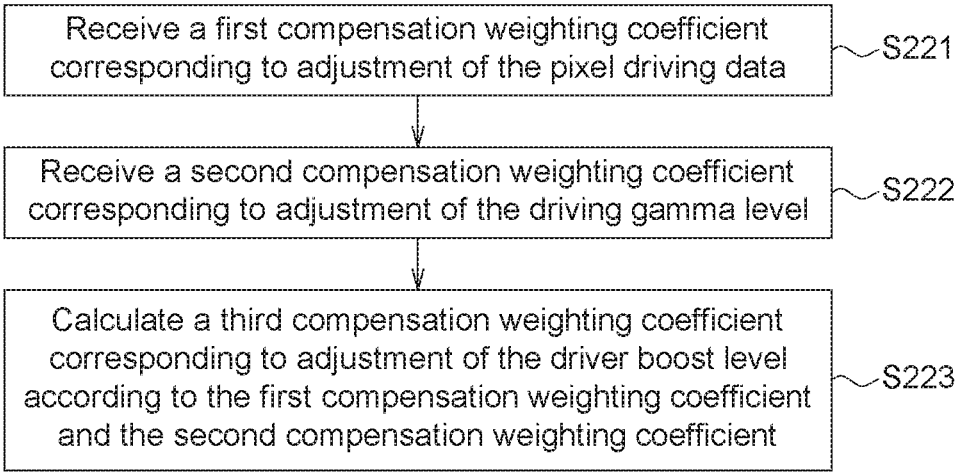
FIG. 7 shows a flowchart illustrating obtaining compensation weighting coefficients according to one embodiment of the invention.

FIG. 7 shows a flowchart illustrating obtaining compensation weighting coefficients according to one embodiment of the invention. Step S221: Receive a first compensation weighting coefficient corresponding to adjustment of the pixel driving data. Step S222: Receive a second compensation weighting coefficient corresponding to adjustment of the driving gamma level. Step S223: Calculate a third compensation weighting coefficient corresponding to adjustment of the driver boost level according to the first compensation weighting coefficient and the second compensation weighting coefficient. The second weight control circuit 114 in FIG. 4 is one embodiment for carrying out the method shown in FIG. 7.

The data compensation circuit 122 is configured to multiply the gain coefficient Gain by the first compensation weighting coefficient WT_CP1 to generate a first adjustment coefficient CG1. The data compensation circuit 122 then multiplies the original image data I_data by the first adjustment coefficient CG1 to generate the pixel driving data D_data. For example, the original image data I_data includes RGB values Ri, Gi, Bi. The pixel driving data D_data includes RGB values Ro, Go, Bo, where Ro=Ri×CG1 , Go=Gi×CG1, Bo=Bi×CG1. The first adjustment coefficient CG1 is greater than 1 such that the image brightness is enhanced.

Figure 8:
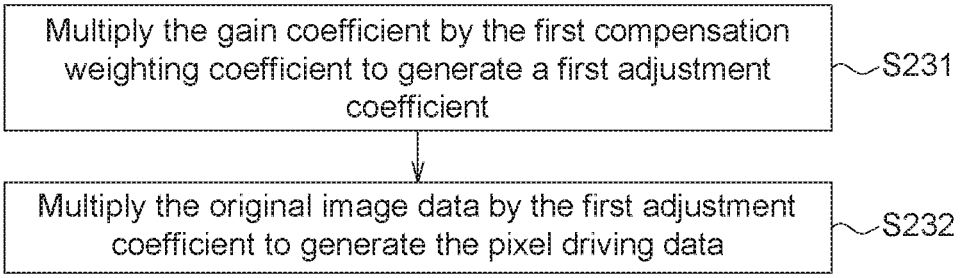
FIG. 8 shows a flowchart illustrating generating the pixel driving data according to one embodiment of the invention.

FIG. 8 shows a flowchart illustrating generating the pixel driving data according to one embodiment of the invention. Step S231: Multiply the gain by the first compensation weighting coefficient to generate a first adjustment coefficient. Step S232: Multiply the original image data by the first adjustment coefficient to generate the pixel driving data. The data compensation circuit 122 in FIG. 4 is one embodiment for carrying out the method shown in FIG. 8.

The second lookup table circuit 108 provides a gamma value GMV corresponding to the luminance value APL. The second lookup table circuit 108 may be pre-constructed. The second lookup table circuit 108 receives the luminance value APL and outputs the corresponding gamma value GMV, which may represent the original gamma value without brightness compensation. For example, larger luminance value APL is corresponding to larger gamma value GMV.

The gamma compensation circuit 124 is configured to multiply the gain coefficient Gain by the second compensation weighting coefficient WT_CP2 to generate a second adjustment coefficient CG2. The gamma compensation circuit 124 then multiplies the gamma value GMV by the second adjustment coefficient CG2 to generate the driving gamma level GMAS. The second adjustment coefficient CG2 is greater than 1 such that the image brightness is enhanced.

Figure 9:
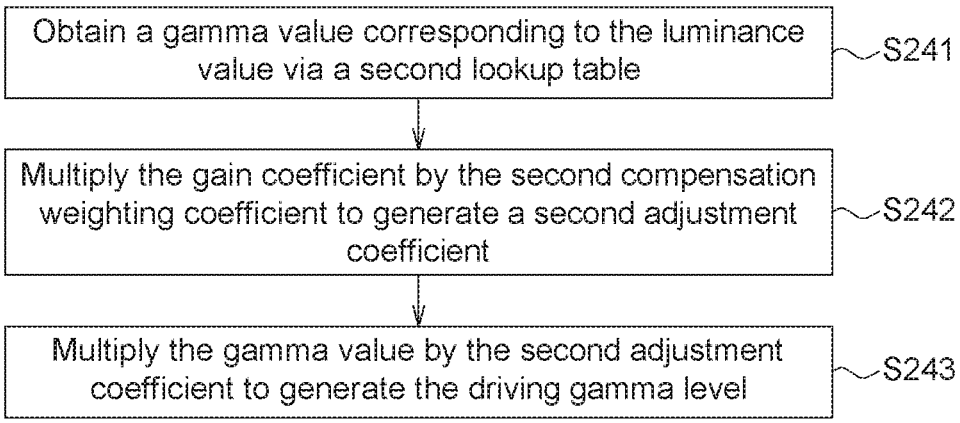
FIG. 9 shows a flowchart illustrating generating the driving gamma level according to one embodiment of the invention.

FIG. 9 shows a flowchart illustrating generating the driving gamma level according to one embodiment of the invention. Step S241: Obtain a gamma value corresponding to the luminance value via a second lookup table. Step S242: Multiply the gain coefficient by the second compensation weighting coefficient to generate a second adjustment coefficient. Step S243: Multiply the gamma value by the second adjustment coefficient to generate the driving gamma level. The second lookup table circuit 108 and the gamma compensation circuit 124 in FIG. 4 is one embodiment for carrying out the method shown in FIG. 9.

The voltage current compensation circuit 126 is configured to multiply the gain coefficient Gain by the third compensation weighting coefficient WT_CP3 to generate a third adjustment coefficient CG3. The voltage current compensation circuit 126 then multiplies a boost value B0 by the third adjustment coefficient CG3 to generate the driver boost level Boost_L. The boost value B0 may be a default fixed value. For example, the boost value B0 is related to the number of adjustable boost levels of the backlight unit.

In one embodiment, the boost value B0 may be calculated by the voltage current compensation circuit 126. For example, the boost value B0 is calculated according to a difference between the equivalent brightness value EBV and the backlight display brightness value BBL_DBV. In this embodiment, the compensation control circuit 110 may provide the equivalent brightness value EBV and the backlight display brightness value BBL_DBV to the voltage current compensation circuit 126.

In still another embodiment, the boost value B0 is first calculated according to a difference between the equivalent rightness value EBV and the backlight display brightness value BBL_DBV. If the boost value B0 thus obtained is greater than a predetermined threshold value, the boost value is B0 is changed to a default preset value corresponding to the backlight unit.

Figure 10:
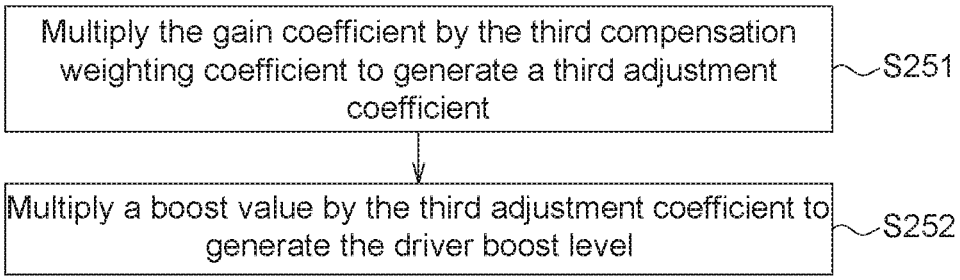
FIG. 10 shows a flowchart illustrating generating the driver boost level according to one embodiment of the invention.

FIG. 10 shows a flowchart illustrating generating the driver boost level according to one embodiment of the invention. Step S251: Multiply the gain coefficient by the third compensation weighting coefficient to generate a third adjustment coefficient. Step S252: Multiply a boost value by the third adjustment coefficient to generate the driver boost level. The voltage current compensation circuit 126 in FIG. 4 is one embodiment for carrying out the method shown in FIG. 10.

According to the embodiments given above, by receiving the original image data and the backlight timing parameters, the brightness compensation method adjusts at least one of the output parameters, including the pixel driving data, the driving gamma level, and the driver boost level, to enhance the image brightness. By adopting the proposed brightness compensation method, because the image brightness is improved, the backlight on-time can be shortened, which effectively reduces the ghost image area. Moreover, the adjustment of the output parameters can be flexibly set by controlling compensation weighting coefficients. The flexibility in tuning the weighting between the output parameters makes the proposed brightness compensation method suitable in a wide variety of circuit applications.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A brightness compensation method for a display device, comprising:

receiving original image data; receiving backlight timing parameters;

performing brightness compensation according to the image data and the backlight timing parameters;

calculating a luminance value according to the original image data;

obtaining a display brightness value corresponding to the luminance value via a first lookup table;

calculating a backlight display brightness value according to the backlight timing parameters;

calculating an equivalent briqhtness value according to the display briqhtness value and the backlight display brightness value; and generating a gain coefficient according to the equivalent brightness value and the backlight display brightness value; and wherein the step of performing brightness compensation comprises adjusting at least one of the pixel driving data, the driving gamma level, and the driver boost level according to the gain coefficient.

2. The brightness compensation method according to claim 1, further comprising calculating a luminance value according to the original image data, wherein the step of performing brightness compensation is based on the luminance value and the backlight timing parameters.

3. The brightness compensation method according to claim 1, further comprising receiving a brightness weighting coefficient, wherein the step of calculating the equivalent brightness value comprises calculating a weighted sum of the display brightness value and the backlight display brightness value according to the brightness weighting coefficient.

4. The brightness compensation method according to claim 1, wherein the gain coefficient is obtained according to the equivalent brightness value divided by the backlight display brightness value.

5. The brightness compensation method according to claim 1, further comprising:

receiving a first compensation weighting coefficient corresponding to adjustment of the pixel driving data;

receiving a second compensation weighting coefficient corresponding to adjustment of the driving gamma level; and calculating a third compensation weighting coefficient corresponding to adjustment of the driver boost level according to the first compensation weighting coefficient and the second compensation weighting coefficient.

6. The brightness compensation method according to claim 5, further comprising:

multiplying the gain coefficient by the first compensation weighting coefficient to generate a first adjustment coefficient; and multiplying the original image data by the first adjustment coefficient to generate the pixel driving data.

7. The brightness compensation method according to claim 5, further comprising:

obtaining a gamma value corresponding to the luminance value via a second lookup table;

multiplying the gain coefficient by the second compensation weighting coefficient to generate a second adjustment coefficient; and multiplying the gamma value by the second adjustment coefficient to generate the driving gamma level.

8. The brightness compensation method according to claim 5, further comprising:

multiplying the gain coefficient by the third compensation weighting coefficient to generate a third adjustment coefficient; and multiplying a boost value by the third adjustment coefficient to generate the driver boost level.

9. The brightness compensation method according to claim 1, wherein the backlight timing parameters comprise a backlight start line, a backlight end line, a front porch length, and a back porch length.

10. A brightness compensation circuit for a display device, comprising:

a content analyzer circuit, for receiving original image data; and a backlight coefficient detection circuit, for receiving backlight timing parameters;

wherein the brightness compensation circuit is configured to adjust at least one of pixel driving data, a driving gamma level, and a driver boost level according to the original image data and the backlight timing parameters; and wherein the content analyzer circuit is configured to calculate a luminance value according to the original image data, the backlight coefficient detection circuit is confiqured to calculate a backlight display briqhtness value according to the backliqht timing parameters, and the brightness compensation circuit further comprises:

a first lookup table circuit, for providing a display brightness value corresponding to the luminance value; and a compensation control circuit, configured to calculate an equivalent brightness value according to the display brightness value and the backlight display brightness value, and generate a gain coefficient according to the equivalent brightness value and the backlight display brightness value;

wherein the brightness compensation circuit is configured to adjust at least one of the pixel driving data, the driving gamma level, and the driver boost level according to the gain coefficient.

11. The brightness compensation circuit according to claim 10, wherein the content analyzer circuit is configured to calculate a luminance value according to the original image data, and the brightness compensation circuit is configured to adjust at least one of the pixel driving data, the driving gamma level, and the driver boost level according to the luminance value and the backlight timing parameters.

12. The brightness compensation circuit according to claim 10, further comprising a first weight control circuit, for receiving a brightness weighting coefficient, wherein the compensation control circuit is configured to calculate a weighted sum of the display brightness value and the backlight display brightness value according to the brightness weighting coefficient to obtain the equivalent brightness value.

13. The brightness compensation circuit according to claim 10, wherein the compensation control circuit is configured to obtain the gain coefficient according to the equivalent brightness value divided by the backlight display brightness value.

14. The brightness compensation circuit according to claim 10, further comprising a second weight control circuit, for receiving a first compensation weighting coefficient corresponding to adjustment of the pixel driving data, and receiving a second compensation weighting coefficient corresponding to adjustment of the driving gamma level, wherein the second weight control circuit is configured to calculate a third compensation weighting coefficient corresponding to adjustment of the driver boost level according to the first compensation weighting coefficient and the second compensation weighting coefficient.

15. The brightness compensation circuit according to claim 14, further comprising a data compensation circuit, configured to:

multiply the gain coefficient by the first compensation weighting coefficient to generate a first adjustment coefficient; and multiply the original image data by the first adjustment coefficient to generate the pixel driving data.

16. The brightness compensation circuit according to claim 14, further comprising:

a second lookup table circuit, for providing a gamma value corresponding to the luminance value; and a gamma compensation circuit, configured to multiply the gain coefficient by the second compensation weighting coefficient to generate a second adjustment coefficient, and multiply the gamma value by the second adjustment coefficient to generate the driving gamma level.

17. The brightness compensation circuit according to claim 14, further comprising a voltage current compensation circuit, configured to:

multiply the gain coefficient by the third compensation weighting coefficient to generate a third adjustment coefficient; and multiply a boost value by the third adjustment coefficient to generate the driver boost level.

18. The brightness compensation circuit according to claim 10, wherein the backlight timing parameters comprise a backlight start line, a backlight end line, a front porch length, and a back porch length.

* * * * *